US006393675B1

(12) United States Patent
Gaetke

(10) Patent No.: US 6,393,675 B1
(45) Date of Patent: May 28, 2002

(54) METHOD AND DEVICE FOR RETAINING PARTIALLY ROLLED-UP COLLAPSIBLE CONTAINERS

(76) Inventor: Hubert J. Gaetke, 6630 Dartmoor Way, San Jose, CA (US) 95129

( * ) Notice: Subject to any disclaimer, the term of this patent is extended or adjusted under 35 U.S.C. 154(b) by 0 days.

(21) Appl. No.: 08/990,945

(22) Filed: Dec. 15, 1997

Related U.S. Application Data

(63) Continuation-in-part of application No. 08/601,289, filed on Feb. 16, 1996, now Pat. No. 5,697,139.

(51) Int. Cl.[7] ..... B42F 1/10
(52) U.S. Cl. ..... 24/563; 24/564; 222/92
(58) Field of Search ..... 24/563, 67 R, 24/564, 555; 222/92, 103, 107

(56) References Cited

U.S. PATENT DOCUMENTS

| | | | | | |
|---|---|---|---|---|---|
| 1,513,009 | A | * | 10/1924 | Robb | 24/564 |
| 1,877,534 | A | | 9/1932 | Rogers | 222/92 |
| 2,035,436 | A | * | 3/1936 | Schafer | 24/259 |
| 2,533,539 | A | | 12/1950 | Vivian | 24/30.5 R |
| 2,941,268 | A | * | 6/1960 | Morse | 24/564 X |
| 2,955,339 | A | * | 10/1960 | Richardson | 24/262 |
| 2,986,793 | A | * | 6/1961 | Bright | 24/564 |
| 3,141,221 | A | | 7/1964 | Faulls, Jr. | 24/30.5 R |
| 3,604,067 | A | * | 9/1971 | Brown | 24/67 R |
| 3,892,334 | A | * | 7/1975 | Hand, II et al. | 221/281 |
| 4,452,943 | A | * | 6/1984 | Goldman | 525/105 |
| 4,563,796 | A | | 1/1986 | Kettlestrings | 24/563 |
| 4,576,314 | A | | 3/1986 | Elias et al. | 222/97 |
| 4,738,007 | A | * | 4/1988 | Demarest | 24/67.9 |
| 4,960,304 | A | * | 10/1990 | Frantz | 297/284.6 |
| 5,082,716 | A | * | 1/1992 | Satterfield et al. | 428/175 |
| 5,271,101 | A | * | 12/1993 | Speth et al. | 2/20 |
| 5,331,015 | A | * | 7/1994 | DeMarais et al. | 521/62 |
| 5,402,558 | A | * | 4/1995 | Santapa | 24/511 |
| 5,442,839 | A | * | 8/1995 | Miller | 24/563 |
| 5,647,106 | A | * | 7/1997 | Hogan | 24/564 X |

* cited by examiner

*Primary Examiner*—Joseph J. Hail, III
(74) *Attorney, Agent, or Firm*—D. E. Schreiber

(57) ABSTRACT

A device for retaining, in a rolled-up configuration, a portion of a collapsible container that holds a quantity of a product. The method includes forming a roll of a collapsible container holding a quantity of a product. The opening of a U-shaped clip is then urged into engagement with the roll of the collapsible container until the opening passes about the roll, and the roll becomes disposed between arms of the U-shaped clip. Thus arranged, an layer of a resilient, open-cell foam material lining the inside of the U-shaped clip is juxtaposed with and compressed by the roll of the collapsible container.

15 Claims, 2 Drawing Sheets

METHOD AND DEVICE FOR RETAINING PARTIALLY ROLLED-UP COLLAPSIBLE CONTAINERS

This is a continuation-in-part of application Ser. No. 08/601,289 filed Feb. 16, 1996, which issued Dec. 16, 1997, as U.S. Pat. No. 5,697,139.

BACKGROUND OF THE INVENTION

1. Field of the Invention

The present invention relates generally to collapsible containers for dispensing a product, and, more particularly, to a method for retaining a portion of such containers in a rolled-up configuration.

2. Description of the Prior Art

Dispensing a paste product, such as toothpaste, from a collapsible tube frequently, if not invariably, requires rolling-up, or folding-up, an end of the tube that is located furthest from an end of the tube which dispenses the paste. Years ago, such tubes were made exclusively from a soft metal that would take and hold a "set." Once one end of such a soft metal tube had been rolled-up or folded, the tube would retain the rolled-up configuration. Presently, many such tubes are made from a polymeric material that is more resilient than the material used for metal tubes. That is, such plastic tubes do not take and hold a "set" as well as the metallic tubes.

For certain individuals, the resiliency of present tubes presents an insurmountable problem. Specifically, a physically handicapped individual who has the use of only one hand may be unable to dispense a paste from a partially empty, resilient, polymeric material tube. While such an individual may, using only one hand, be able to roll-up or fold-up a resilient, polymeric material tube, upon releasing the tube it immediately unrolls thereby frustrating an attempt to dispense the product from the tube.

While the preceding problem may be most exacerbating when dispensing a paste from a tube, an analogous problem arises in holding closed plastic product bags, such as snack food bags, that are also made from a resilient polymeric material. In both instances, resilient, polymeric material must be retained in a rolled-up configuration. The most significant difference in retaining a roll of resilient, polymeric material of a tube or of a bag is that, a bag must be unrolled and rerolled each occasion product is removed from the bag. Conversely, in principle a tube need never be unrolled, and the tube need be further rolled-up only intermittently as product is dispensed from the opposite end of the tube.

While it may be readily apparent that mechanically retaining a rolled-up end of a tube or bag addresses the preceding difficulties, the form for and method of using such a mechanical retainer is not readily apparent. In both of the preceding situations, but particularly when dispensing a paste product from a tube, the mechanical retainer must accommodate an ever larger roll of polymeric material as the tube or bag retains ever less product. Moreover, such polymeric tube or bag materials are slick which permits them to easily slip out of simple, common mechanical retainers.

SUMMARY OF THE INVENTION

An object of the present invention is to provide a simple method and device for retaining a product container in a rolled-up or folded-up configuration.

Another object of the present invention is to provide a simple method and device for retaining a product container in a rolled-up or folded-up configuration that may be easily installed or removed.

Another object of the present invention is to provide a method and device for retaining a product container in a rolled-up or folded-up configuration that does not inadvertently slip off.

Another object of the present invention is to provide a method and device for retaining a product container in a rolled-up or folded-up configuration that does not cut or scratch the product container.

Another object of the present invention is to provide a simple method and device for retaining a product container in a rolled-up or folded-up configuration that may be performed using only one hand.

Yet another object of the present invention is to provide an economic method and device for retaining a product container in a rolled-up or folded-up configuration.

Briefly, the present invention includes both a method and device for retaining, in a rolled-up configuration, a portion of a collapsible container that holds a quantity of a product. The method includes forming at least a portion of a collapsible container holding a quantity of a product into a convoluted roll. A U-shaped clip, having a thick inner layer of a resilient, open-cell foam material bonded to a much thinner, continuous, outer structural layer of a flexible material, is slipped about the convoluted roll. The layer of structural material, which supports the foam material, includes a pair of opposing, spaced-apart arms that are joined to each other by a juncture segment of the layer of structural material located at a base of the U-shaped clip. The inner layer of foam material substantially fills a gap located between the opposing, spaced-apart arms of the U-shaped clip. The opposing, spaced-apart arms provide an opening between ends thereof, that extend away from the base of the U-shaped clip, which is adapted for admitting a convoluted roll of a collapsible container between the opposing, spaced-apart arms. When the convoluted roll is disposed between the spaced-apart arms, the foam material becomes juxtaposed with and compresses to conform to the convoluted roll.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

Figure 1:
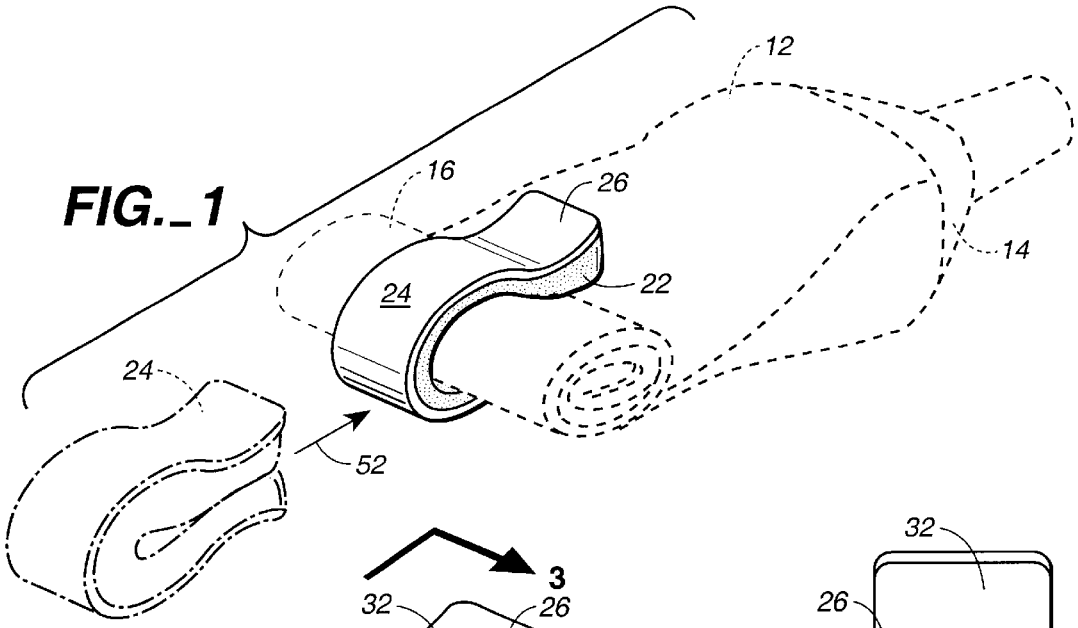
FIG. 1 is a perspective drawing illustrating, in accordance with the present invention, engagement and juxtaposition of an inner layer of resilient, open-cell foam material included in a U-shaped clip with a partially rolled-up, collapsible container.
Figure 2:
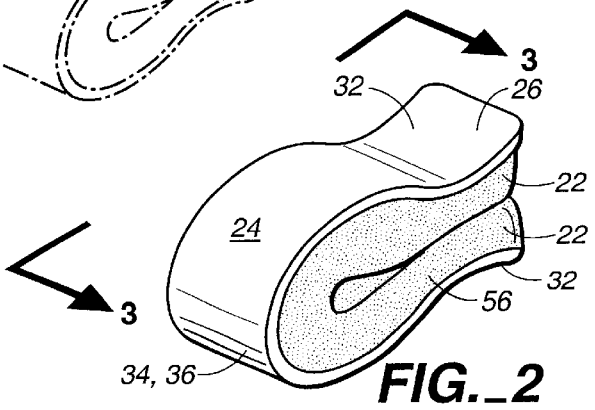
FIG. 2 is a perspective drawing illustrating in greater detail the U-shaped clip depicted in FIG. 1.
Figure 4:
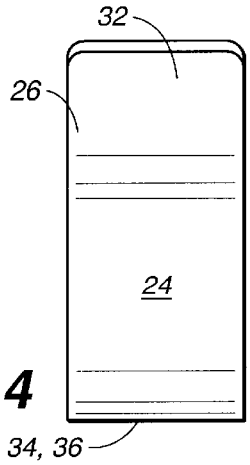
FIG. 4 is a plan view of the U-shaped clip taken along the line 4—4 in FIG. 3.

FIG. 1 illustrates a collapsible container 12 illustrated in FIG. 1 with dashed lines, e.g a toothpaste tube, that holds a quantity of a product. A portion of the collapsible container 12, furthest from an end 14, which in the instance of a toothpaste tube dispenses the product, has been formed into a convoluted roll 16. FIG. 1 also illustrates engagement and juxtaposition of a thick inner layer 22 of resilient, open-cell foam material included in a U-shaped clip 24 with the convoluted roll 16 of the collapsible container 12. As illustrated in FIG. 1, when the U-shaped clip 24 is applied to the collapsible container 12 the inner layer 22 becomes juxtaposed with and compresses to conform to the convoluted roll 16. Referring now to FIGS. 3 through 7, the inner layer 22 of the U-shaped clip 24 is bonded to a continuous, outer layer 26 of a structural material that is much thinner than the inner layer 22.

Figure 3:
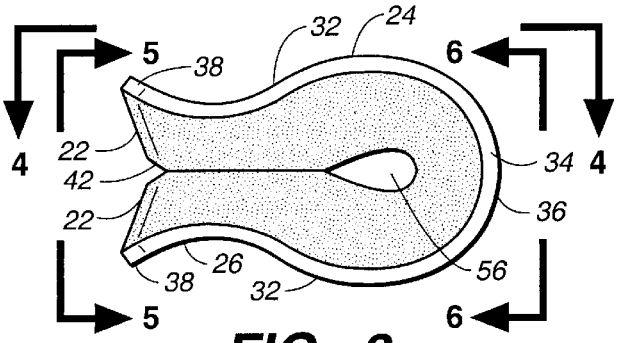
FIG. 3 is an elevational view of the U-shaped clip taken along the line 3—3 in FIG. 2.
Figure 5:
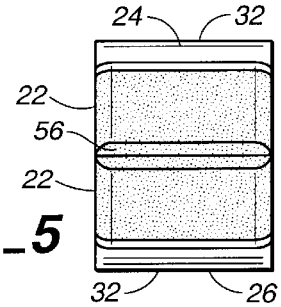
FIG. 5 is an elevational view of the U-shaped clip taken along the line 5—5 in FIG. 3.
Figure 6:
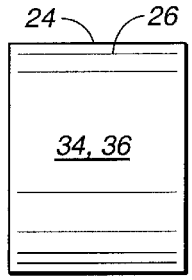
FIG. 6 is an elevational view of the U-shaped clip taken along the line 6—6 in FIG. 3.
Figure 7:
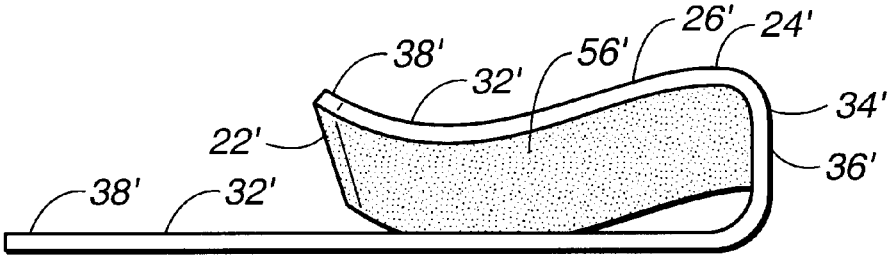
FIG. 7 is an elevational view, similar to the view of FIG. 3, of an alternative embodiment U-shaped clip in accordance with the present invention.

The outer layer 26 of the U-shaped clip 24 provides a pair of opposing, spaced-apart arms 32, most clearly illustrated in FIGS. 3 and 7. As best illustrated by an alternative embodiment of the present invention depicted in FIG. 7, the opposing, spaced-apart arms 32 are joined together by a juncture segment 34 of the outer layer 26 that is located at a base 36 of the U-shaped clip 24. Those elements of the alternative embodiment U-shaped clip 24 depicted in FIG. 7 that are common to the U-shaped clip 24 depicted in FIGS. 1–6 carry the same reference numeral distinguished by a prime ("′") designation. Ends 38 of the opposing, spaced-apart arms 32 that extend away from the base 36 of the U-shaped clip 24 provide an opening 42.

Referring again to FIG. 1, to retain the collapsible container 12 in the rolled-up configuration, the inner layer 22 about the opening 42 provided by the opposing, spaced-apart arms 32 is urged into engagement with the convoluted roll 16, as illustrated by an arrow 52 in FIG. 1, until the opening 42 passes about the convoluted roll 16. In this way, the convoluted roll 16 becomes disposed between the opposing, spaced-apart arms 32 of the U-shaped clip 24 with the foam material inner layer 22 being juxtaposed with and compressing to conform to the convoluted roll 16 of the collapsible container 12.

As best illustrated in FIG. 3, spacing between the opposing, spaced-apart arms 32 of the outer layer 26 preferably varies along the opposing, spaced-apart arms 32 extending from the juncture segment 34 at the base 36 of the U-shaped clip 24 to the ends 38 of the opposing, spaced-apart arms 32 distal from the base 36. More specifically, spacing between the opposing, spaced-apart arms 32 preferably increases to a maximum extent immediately adjacent to the base 36, and then decreases to a minimum further away from the base 36. Finally, about the opening 42, the ends 38 of the opposing, spaced-apart arms 32 again diverge away from each other. The preceding shape for the U-shaped clip 24 well suited for accommodating the convoluted roll 16 of the collapsible container 12.

Figure 8:
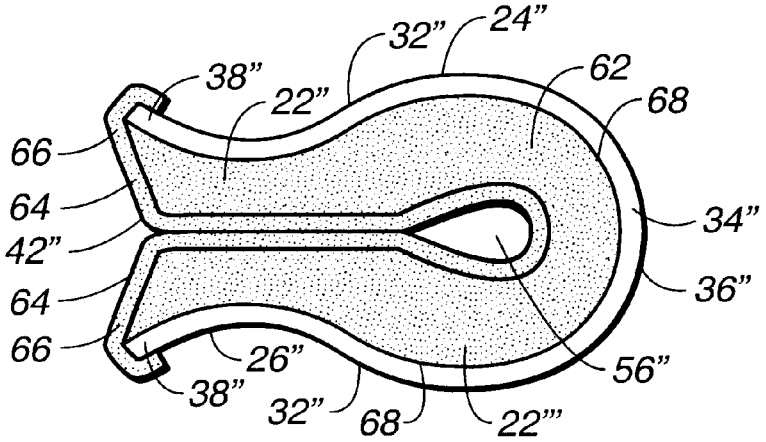
FIG. 8 is an elevational view, similar to the view of FIG. 3, of an alternative embodiment U-shaped clip having laminated layers of resilient material one of which covers projecting ends of the clip's opposing, spaced-apart arms.

FIG. 8 depicts an alternative embodiment of the U-shaped clip 24 having a laminated inner layer 22. Those elements of the alternative embodiment U-shaped clip 24 depicted in FIG. 8 that are common to the U-shaped clip 24 depicted in FIGS. 1–6 carry the same reference numeral distinguished by a double prime ("″") designation. The laminated inner layer 22″ includes a first layer 62 of foam material that is bonded to the outer layer 26″. The first layer 62 is covered by a second layer 64 of open cell foam material which is bonded to a surface 66 of the first layer 62 opposite to a surface 68 of the first layer 62 that is bonded to the outer layer 26″. Because only the second layer 64 can contact the convoluted roll 16 of the collapsible container 12, only the second layer 64 need be made from an open cell foam material. Preferably, the second layer 64 encircles the ends 38″ of the opposing, spaced-apart arms 32″ of the outer layer 26″.

Figure 9:
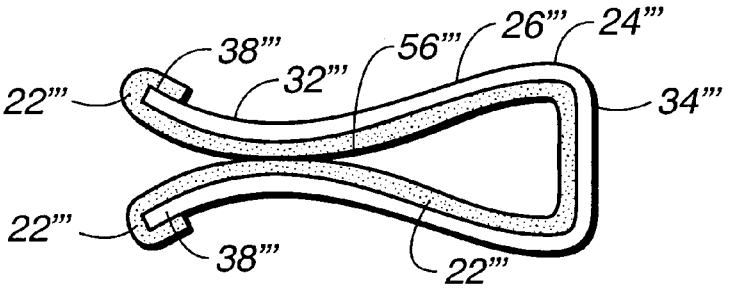
FIG. 9 is an elevational view, similar to the view of FIG. 3, of an alternative embodiment U-shaped clip having a single, thin layer of resilient material one of which covers projecting ends of the clip's opposing, spaced-apart arms.

FIG. 9 depicts yet another alternative embodiment of the U-shaped clip 24. Those elements of the alternative embodiment U-shaped clip 24 depicted in FIG. 9 that are common to the U-shaped clip 24 depicted in FIGS. 1–6 carry the same reference numeral distinguished by a triple prime ("‴") designation. In the embodiment depicted in FIG. 9, the inner layer 22‴ is formed by a thin layer of open cell foam material arranged to encircle the ends 38‴ of the opposing, spaced-apart arms 32‴ of the outer layer 26‴.

It has been experimentally determined that the inner layer 22 is preferably formed from a high-density, open-cell polyurethane material. Neither foam rubber nor cloth possess sufficient compressibility, or exhibit sufficient friction to retain the U-shaped clip 24 on the resilient polymeric material presently used for collapsible containers 12 such as an 8.0 oz. toothpaste tube. When bonded to and supported by the outer layer 26, high-density, open-cell polyurethane material exhibits frictional properties which permit the inner layer 22 to not stick, but to slide easily across the resilient polymeric material presently used for collapsible containers 12 such as toothpaste tubes. However, after the U-shaped clip 24 has been installed onto the convoluted roll 16, the high-density, open-cell polyurethane material compresses sufficiently and exhibits sufficient friction that the U-shaped clip 24 does not inadvertently slip off the convoluted roll 16.

The U-shaped clip 24, when adapted for use with a standard sized, 8.0 oz., toothpaste tube, is preferably approximately 1.5 inches long from the base 36 to the ends 38. The thick, high-density, open-cell polyurethane inner layer 22 adapted for use with such a collapsible container 12 is at least 0.125 in thick, and is preferably 0.250 in. or more thick. The much thinner outer layer 26 may be formed from a thermoformable, hi-impact styrene material 0.060 in thick. Alternatively, the outer layer 26 may be formed from another polymeric or a metallic material that exhibits mechanical properties similar to hi-impact styrene material. The U-shaped clip 24 preferably has a width across the opposing, spaced-apart arms 32 of approximately 0.625 in. A gap 56 between the opposing, spaced-apart arms 32 preferably increases to a maximum width of approximately 0.600 in. both adjacent to the base 36 and at the ends 38. Between these locations of maximum width, the gap 56 between the opposing, spaced-apart arms 32 decreases to approximately 0.400 in. Accordingly, the thick inner layer 22 substantially fills the gap 56 between the opposing, spaced-apart arms 32 even if the U-shaped clip 24 is not retaining the convoluted roll 16 of the collapsible container 12.

To fabricate the U-shaped clip 24, a sheet of foam material is bonded to a sheet of hi-impact styrene material, polycarbonate material such as Lexan®, or metallic material. This bond is preferably formed by a rubber-based, double sided, pressure-sensitive-adhesive tape such as Avery 8302 which provides an immediate, high-shear bond between the inner layer 22 and the outer layer 26. A high-shear bond between the inner layer 22 and the outer layer 26 resists peeling of the inner layer 22 off the outer layer 26 as the U-shaped clip 24 slides past the convoluted roll 16 of the collapsible container 12. To assist in resisting peeling, the edges of the inner layer 22 immediately adjacent to the ends 38 may be beveled before bonding the inner layer 22 and outer layer 26 together. The second layer 64 and inner layer 22''' of thin open cell foam material, e.g. 0.100 inch thick, respectively depicted in FIGS. 8 and 9 similarly assists in resisting peeling of the inner layer 22 from the outer layer 26 by encircling the ends 38'' or 38''' of the opposing, spaced-apart arms 32'' or 32'' of the outer layer 26'' or 26'''.

The bonded sheet, consisting of foam material and structural material, is then cut into elongated strips having a width substantially equal to the distance between the ends 38 along the outer layer 26. These strips of bonded foam material and structural material are then formed into various shapes such as those depicted in FIGS. 3, 7, 8 or 9, or any other equivalent desired shape. If the outer layer 26 if formed by hi-impact styrene material, the bonded sheet is thermoformed. If the outer layer 26 is formed by a polycarbonate material such as Lexan, then the bonded sheet may be formed mechanically as contrasted with thermoforming. Finally, the formed strips are cut into individual U-shaped clips 24 having any desired width, for example 0.625 in.

Alternatively, the outer layer 26 substantially in its final finished shape may first be extruded, after which the inner layer 22 is bonded to the extruded outer layer 26. Bonding the inner layer 22 to a pre-shaped, extruded outer layer 26 eliminates any need for thermoforming or mechanically forming a flat, bonded sheet of the inner layer 22 and the outer layer 26 before cutting bonded strips into the U-shaped clips 24.

Although the present invention has been described in terms of the presently preferred embodiment, it is to be understood that such disclosure is purely illustrative and is not to be interpreted as limiting. While the method of the present invention has been illustrated above in connection with retaining a rolled-up toothpaste tube, the method may also be employed to hold closed other types of collapsible product containers. For-example, the method of the present invention may be used to retain a rolled-up plastic bag that contains a product such as a snack food, or may be used to retain unconvoluted objects that are sufficiently thick to compress the inner layer 22 of foam material. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A U-shaped clip adapted for retaining in a rolled-up configuration a portion of a collapsible container that holds a quantity of a product, the U-shaped clip comprising:

an inner layer of a resilient open-cell foam material; and a continuous, outer layer of structural material to which said inner layer of foam material is bonded, said layer of structural material mechanically supporting said inner layer of foam material; said layer of structural material including a pair of opposing, spaced-apart arms that are joined to each other by a juncture segment of said layer of structural material located at a base of the U-shaped clip; said inner layer of foam material substantially filling a gap located between the opposing, spaced-apart arms of the U-shaped clip; and the opposing, spaced-apart arms providing an opening between projecting ends thereof that extend away from the base of the U-shaped clip, the opening being adapted for admitting a convoluted roll of a collapsible container into the U-shaped clip between the opposing, spaced-apart arms thereof with open-cell foam material included in said inner layer of foam material becoming juxtaposed with and compressing to conform to the convoluted roll.

2. The U-shaped clip of claim 1 wherein said inner layer of resilient foam material is open-cell foam material that is much thicker than said layer of structural material.

3. The U-shaped clip of claim 1 wherein the inner layer of resilient foam material is laminated having a first layer of foam material that is bonded to said layer of structural material, the first layer of foam material being covered by a second layer of open cell foam material which is bonded to a surface of the first layer opposite to a surface thereof that is bonded to said layer of structural material.

4. The U-shaped clip of claim 3 wherein the second layer encircles the projecting ends of the opposing, spaced-apart arms of said layer of structural material.

5. The U-shaped clip of claim 1 wherein said inner layer of resilient foam material is open-cell foam material having a thickness approximately equal to a thickness of said layer of structural material, said inner layer of resilient foam material encircling the projecting ends of the opposing, spaced-apart arms of said layer of structural material.

6. The U-shaped clip of claim 1 wherein the gap between the opposing, spaced-apart arms of the U-shaped clip varies along the opposing, spaced-apart arms extending from the juncture segment located at the base of the U-shaped clip to the projecting ends of the opposing, spaced-apart arms distal from the base thereof.

7. The U-shaped clip of claim 6 wherein the opposing, spaced-apart arms of the U-shaped clip diverge away from each other about the projecting ends thereof.

8. The U-shaped clip of claim 1 wherein the opposing, spaced-apart arms of the U-shaped clip diverge away from each other about the projecting ends thereof.

9. The U-shaped clip of claim 1 wherein the foam material of said inner layer is a high-density, open-cell polyurethane material.

10. The U-shaped clip of claim 1 wherein said layer of structural material is formed from a thermoformable, hi-impact styrene material.

11. The U-shaped clip of claim 10 wherein the foam material of said inner layer includes a high-density, open-cell polyurethane material.

12. The U-shaped clip of claim 1 wherein said layer of structural material is formed from a polycarbonate material.

13. The U-shaped clip of claim 12 wherein the foam material of said inner layer includes a high-density, open-cell polyurethane material.

14. The U-shaped clip of claim 1 wherein said layer of structural material is formed from a metal.

15. The U-shaped clip of claim 14 wherein the foam material of said inner layer includes a high-density, open-cell polyurethane material.

* * * * *